United States Patent [19]

Ashok et al.

[11] Patent Number: 4,945,973

[45] Date of Patent: Aug. 7, 1990

[54] THERMAL CONDUCTIVITY OF SUBSTRATE MATERIAL CORRELATED WITH ATOMIZING GAS-PRODUCED STEADY STATE TEMPERATURE

[75] Inventors: Sankaranarayanan Ashok, Bethany; W. Gary Watson, Cheshire; Harvey P. Cheskis, North Haven, all of Conn.

[73] Assignee: Olin Corporation, New Haven, Conn.

[21] Appl. No.: 270,605

[22] Filed: Nov. 14, 1988

[51] Int. Cl.[5] ..... B22D 23/00

[52] U.S. Cl. ..... 164/429; 164/46; 164/138; 164/271

[58] Field of Search ..... 164/271, 429, 46, 138, 164/900

[56] References Cited

U.S. PATENT DOCUMENTS

| | | | |
|---|---|---|---|
| Re. 31,767 | 12/1984 | Brooks | 29/527.2 |
| 2,559,351 | 7/1951 | Drake et al. . | |
| 2,972,185 | 2/1961 | Brennan | 29/420.5 |
| 3,608,615 | 9/1971 | Conlon . | |
| 3,727,672 | 4/1973 | Grenfell | 164/281 |
| 3,742,585 | 7/1973 | Wentzell | 29/423 |
| 3,775,156 | 11/1973 | Singer . | |
| 3,826,301 | 7/1974 | Brooks | 164/46 |
| 3,909,921 | 10/1975 | Brooks | 29/527.2 |
| 4,512,384 | 4/1985 | Sendzimir | 164/46 |
| 4,522,847 | 6/1985 | Cornet et al. | 427/55 |
| 4,546,815 | 10/1985 | Liebermann et al. | 164/463 |
| 4,582,117 | 4/1986 | Kushnick | 164/463 |
| 4,588,021 | 5/1986 | Bergeron et al. | 164/432 |
| 4,642,130 | 2/1987 | Hargreaves et al. | 65/60.1 |
| 4,721,154 | 1/1988 | Christ et al. | 164/452 |

FOREIGN PATENT DOCUMENTS

| | | | |
|---|---|---|---|
| 0225080 | 6/1987 | European Pat. Off. . | |
| 0225732 | 6/1987 | European Pat. Off. . | |
| 55-45551 | 3/1980 | Japan | 164/271 |
| 1472939 | 5/1977 | United Kingdom . | |
| 2007129A | 5/1979 | United Kingdom . | |
| 1548616 | 7/1979 | United Kingdom . | |
| 1599392 | 9/1981 | United Kingdom . | |
| 2172827A | 10/1986 | United Kingdom . | |
| 2172900A | 10/1986 | United Kingdom . | |

OTHER PUBLICATIONS

R. W. Evans et al., "The Osprey Preform Process", 1985, pp. 13–20, Powder Metallurgy, vol. 28, No. 1.

A. G. Leatham et al., "The Osprey Process for the Production of Spray-Deposited Roll, Disc, Tube and Billet Preforms", 1985, pp. 157–173, *Modern Developments in Powder Metallurgy*, vols. 15–17.

*Primary Examiner*—Richard K. Seidel
*Assistant Examiner*—J. Reed Batten, Jr.
*Attorney, Agent, or Firm*—H. Samuel Kieser

[57] ABSTRACT

A molten metal gas-atomizing spray-depositing apparatus has an atomizer which employs a pressurized gas flow for atomizing a stream of molten metal into a spray pattern of semi-solid metal particles and producing a flow of the particles along with the gas flow in a generally downward direction. The apparatus also has a substrate disposed below the atomizer for impingement on the substrate of the gas flow at a steady state temperature resulting from heat transfer by the metal particles to the gas flow and for receiving a deposit of the particles in the spray pattern to form a product thereon. The substrate is composed of a material having a thermal conductivity primarily correlated with the steady state temperature of the gas flow so as to limit heat transfer from the deposit to the substrate and provide a sufficient fraction of liquid in the initial deposit to feed the interstices between the particles and provide an interface for subsequent deposits, resulting in a reduction of porosity and improvements of flatness of the deposit.

7 Claims, 2 Drawing Sheets

THERMAL CONDUCTIVITY OF SUBSTRATE MATERIAL CORRELATED WITH ATOMIZING GAS-PRODUCED STEADY STATE TEMPERATURE

BACKGROUND OF THE INVENTION

1. Field of the Invention

The present invention generally relates to spray-deposited production of a product on a moving substrate and, more particularly, is concerned with the material composing the substrate having a thermal conductivity correlated with steady state temperature conditions produced by the atomizing gas.

2. Description of the Prior Art

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R. W. Evans et al, *Powder Metallurgy*, Vol. 28, No. 1 (1985), pages 13–20 and "The Osprey Process for the Production of Spray-Deposited Roll, Disc, Tube and Billet Preforms" by A. G. Leatham et al, *Modern Developments in Powder Metallurgy*, Vols. 15–17 (1985), pages 157–173.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in European Pat. Appln. No. 225,080. For producing these products, a substrate or collector, such as a flat substrate or an endless belt, is moved continuously through the spray to receive a deposit of uniform thickness across its width.

Heretofore, extensive porosity typically has been observed in a spray-deposited preform at the bottom thereof being its side in contact with the substrate or collector. This well known phenomenon, normally undesirable, is a particular problem in a thin gauge product, such as strip or tube, since the porous region may comprise a significant percentage of the product thickness. The porosity is thought to occur when the initial deposit layer is cooled too rapidly by the substrate, providing insufficient liquid to feed the inherent interstices between the splatted droplets and provide a proper interface with subsequent deposits.

Another defect feature often associated with this substrate region is extensive lifting of initial splats which promotes a non-flat surface. The lifting of the splats is a consequence of solidification contraction and distortion arising from the rapid solidification of the splats.

One approach of the prior art for eliminating these problems is preheating the substrate to minimize or reduce the rate of heat transfer from the initial deposit to the substrate so that some fraction liquid is always available to feed voids created during the spray deposition process. However, it is often difficult to effectively preheat a substrate in a commercial spray deposit system because of the cooling effects of the high velocity recirculating atomizing gas. Further, preheating a substrate increases the potential for the deposit sticking to the substrate.

Therefore, a need exists for an alternative approach to elimination of the porosity problem particularly in thin gauge product produced by the above-described Osprey spray-deposition process.

SUMMARY OF THE INVENTION

The present invention provides a substrate composed of a material designed to satisfy the aforementioned needs. The unique approach of the present invention is the selection a material for the substrate having a thermal conductivity correlated with the steady state temperature of the atomizing gas flow in the spray chamber of the apparatus. The steady state temperature is maintained by the atomizing gas flow which is heated by the molten metal atomized by the gas flow and spray deposited on the substrate in the spray chamber.

Since different metals have different melting temperatures, the particular steady state temperature of the spray chamber and, thus, of the substrate in the chamber primarily depends upon which metal is being processed in the spray chamber. To ensure that the initial deposit on the substrate maintains a sufficient fraction of liquid to provide a wetting interface with subsequent deposits, the material selected for the substrate is one which has a thermal conductivity correlated to the particular steady state temperature so as to limit or minimize heat transfer from the initial deposit to the substrate and thereby prevent complete solidification of the initial deposit.

Accordingly, the present invention is directed to a molten metal gas-atomizing spray-depositing apparatus. The apparatus includes the combination of: (a) means employing a pressurized gas flow for atomizing a stream of molten metal into a spray pattern of semi-solid metal particles and producing a flow of the particles in the pattern thereof along with the gas flow in a generally downward direction; and (b) a substrate disposed below the atomizing means for impingement on the substrate of the gas flow at a particular steady state temperature resulting from heat transfer by the metal particles to the gas flow and for receiving thereon a deposit of the particles in the spray pattern to form a product thereon. The substrate is composed of a material having a thermal conductivity correlated with the particular steady state temperature of the gas flow so as to limit or minimize heat transfer from the initial deposit to the substrate and thereby prevent complete solidification of the initial deposit. Use of a substrate composed of such material ensures that the initial deposit on the substrate maintains a sufficient fraction of liquid to feed the inherent interstices between the splatted droplets and provide a proper interface with subsequent deposits whereby reduction of porosity and improvment of flatness are achieved in the deposit.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Prior Art Spray-Deposition Apparatus

Figure 1:
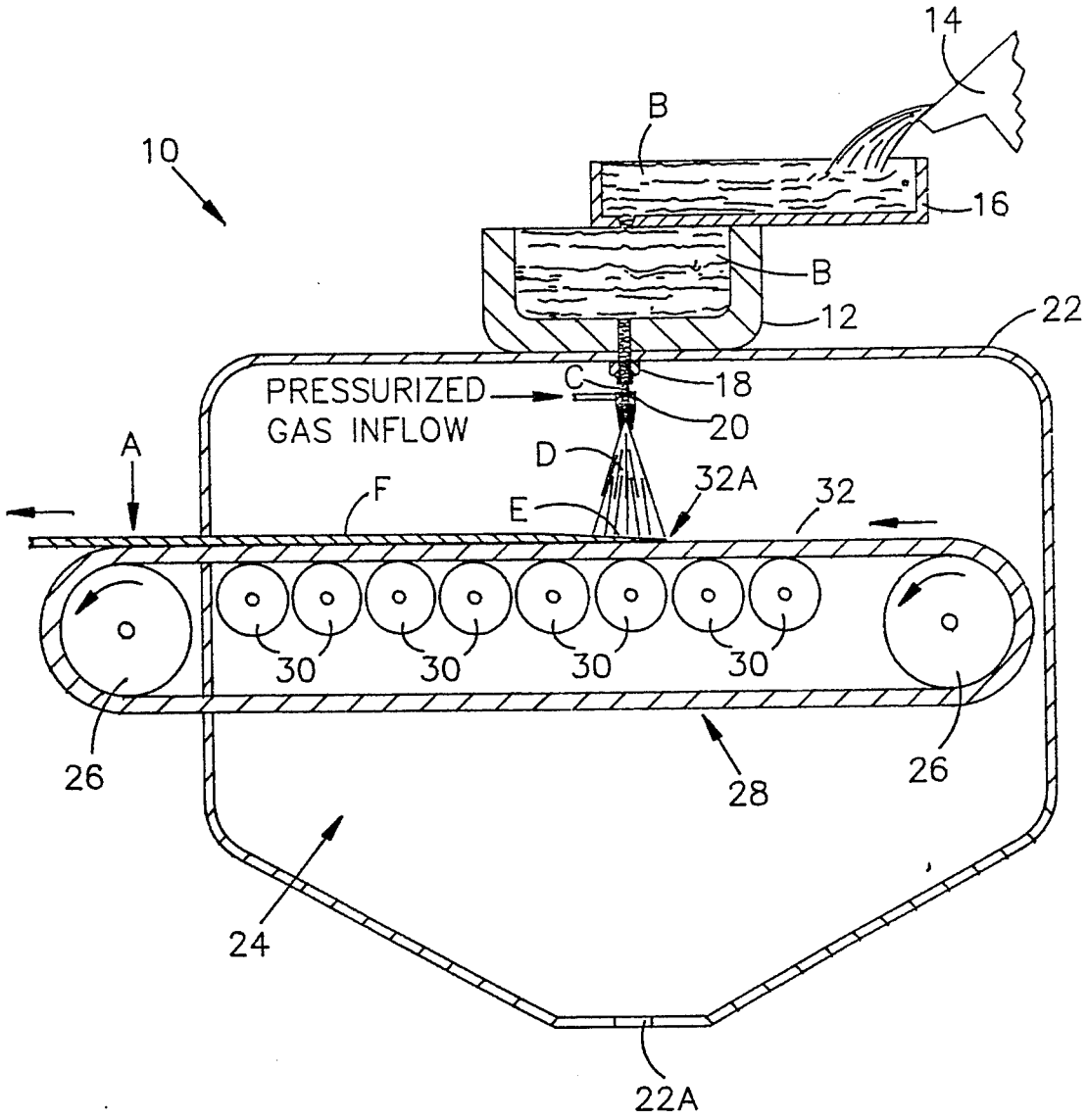
FIG. 1 is a schematic view, partly in section, of a prior art spray-deposition apparatus for producing a product on a moving substrate, such as in thin gauge strip form.

Referring now to the drawings, and particularly to FIG. 1, there is schematically illustrated a prior art spray-deposition apparatus, generally designated by the numeral 10, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downwardly from the tundish 12.

Also, a gas atomizer 20 employed by the apparatus 10 is positioned below the tundish bottom nozzle 18 within a spray chamber 22 of the apparatus 10. The atomizer 20 is supplied with a gas, such as nitrogen, under pressure from any suitable source. The atomizer 20 which surrounds the molten metal stream C impinges the gas on the stream C so as to convert the stream into a spray D of atomized molten metal particles, broadcasting downwardly from the atomizer 20 in the form of a divergent conical pattern. If desired, more than one atomizer 20 can be used. Also, the atomizer(s) can be moved transversely in side-to-side fashion for more uniformly distributing the molten metal particles.

Further, a continuous substrate system 24 employed by the apparatus 10 extends into the spray chamber 22 in generally horizontal fashion and in spaced relation below the gas atomizer 20. The substrate system 24 includes drive means in the form of a pair of spaced rolls 26, an endless substrate 28 in the form of a flexible belt entrained about and extending between the spaced rolls 26, and a series of rollers 30 which underlie and support an upper run 32 of the endless substrate 28. The substrate 28 is composed of a suitable material, such as stainless steel. An area 32A of the substrate upper run 32 directly underlies the divergent pattern of spray D for receiving thereon a deposit E of the atomized metal particles to form the metal strip product A.

The atomizing gas flowing from the atomizer 20 is much cooler than the molten metal B in the stream C. Thus, the impingement of atomizing gas on the spray particles during flight and subsequently upon receipt on the substrate 28 extracts heat therefrom, resulting in lowering of the temperature of the metal deposit E below the solidus temperature of the metal B to form the solid strip F which is carried from the spray chamber 22 by the substrate 28 from which it is removed by a suitable mechanism (not shown). A fraction of the particles overspray the substrate 28 and fall to the bottom of the spray chamber 22 where they along with the atomizing gas flow from the chamber via an exhaust port 22A.

Modifications of the Present Invention

In the prior art apparatus 10, the solid strip F formed on the substrate 28 typically exhibits extensive porosity in its bottom side adjacent the substrate. The cause of this porosity problem is believed to be due to contact with the cooler substrate 28 which together with the impingement of the cool atomizing gas extracts too much heat and thereby lowers the temperature of the spray deposit E too rapidly, starving it of a sufficient fraction of liquid to feed the interstices between splatted droplets.

The solution of the present invention is to select a material for the substrate 28 having a thermal conductivity correlated with the steady state temperature of the atomizing gas flow in the spray chamber 22 of the apparatus 10. The steady state temperature of the chamber 22 surrounding the substrate 28 is produced and maintained by the atomizing gas flow which is heated by the atomized molten metal particles being spray deposited on the substrate in the spray chamber.

Since different metals have different melting temperatures, the steady state temperature of the spray chamber 22 and, thus, of the substrate 28 in the chamber depends primarily upon which metal is being processed in the spray chamber. To ensure that the initial deposit E of particles on the substrate 28 maintains a sufficient fraction of liquid to feed the inherent interstices between the splatted droplets and provide a proper interface for subsequent deposits of particles, the material selected for the substrate 28 is one having a thermal conductivity which minimizes heat transfer from the initial deposit E to the substrate 28 at the particular steady state temperature. In such a way, the thermal conductivity of the selected substrate material is correlated to the particular steady state temperature and to the particular metal being spray deposited for preventing total solidification of the initial deposit E. The result is a reduction of porosity and improvement of flatness of the deposit E.

Figure 2:
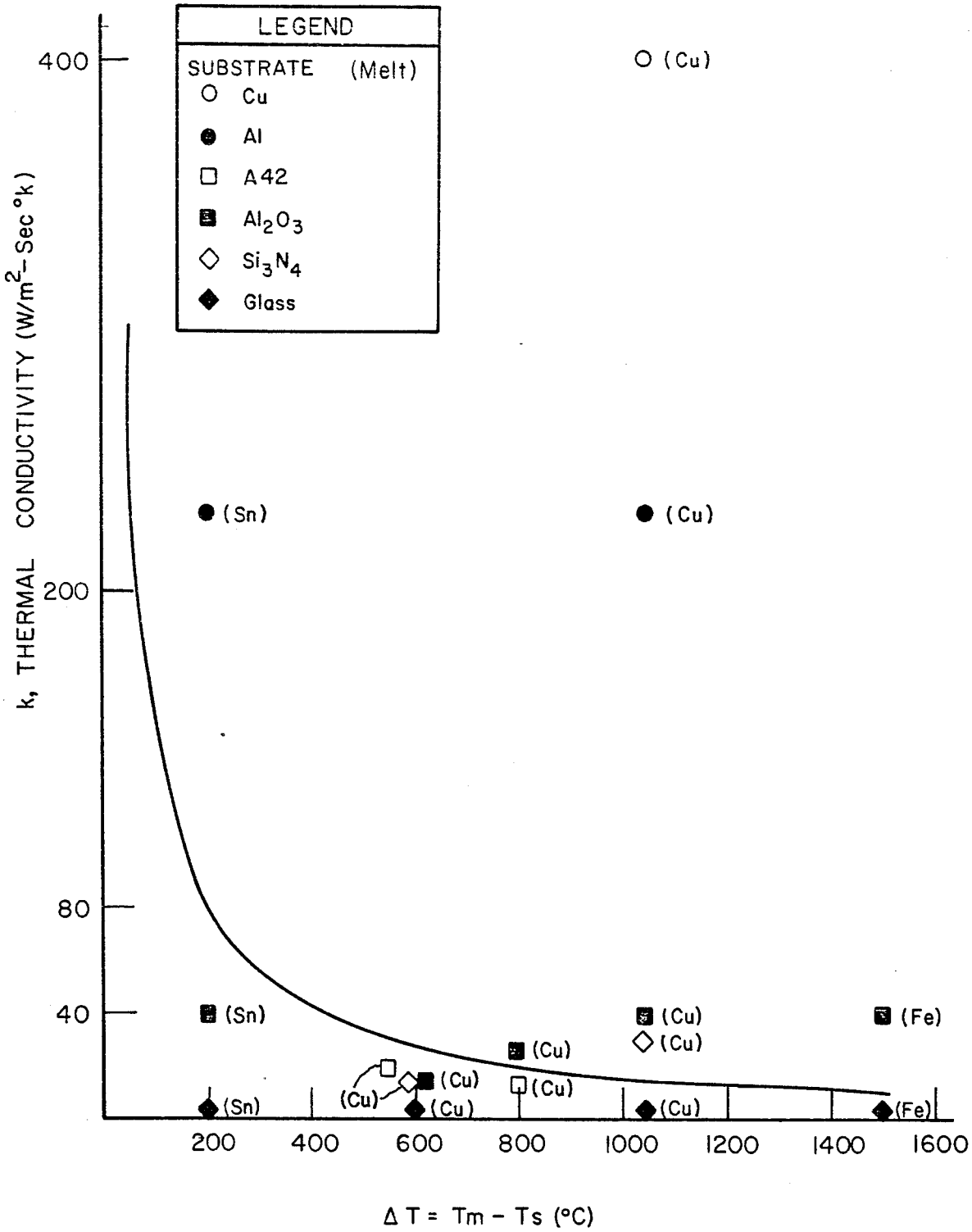
FIG. 2 is a graph of the correlation between a range of steady state temperatures produced by atomizing gas when spray depositing different metals and a range of materials of different thermal conductivities which are respectively appropriate and inappropriate for use at such steady state temperatures in accordance with the principles of the present invention.

FIG. 2 is a graph of the correlation between a range of steady state temperatures produced by atomizing gas when spray depositing different metals and a range of materials of different thermal conductivities which are respectively acceptable and unacceptable for use at such steady state temperatures. The points on the graph represent substrate material/spray deposited metal combinations, with the type of substrate material indicated by the shape of the data point and the spray deposited metal or melt indicated in parentheses. For example, ● (Sn) means the substrate material is aluminum and the spray deposited metal or melt is tin. The X-axis represents the temperature difference between the melting temperature of the metal being spray deposited and the steady state temperature (which is also generally the substrate temperature). The Y-axis represents the thermal conductivity of the substrate material.

The line on the graph is the boundary between satisfactory and unsatisfactory deposits produced by different substrate material and deposit metal combinations at different temperature differences. At the opposite extremes of the boundary line, asymptotic relationships are defined between the temperature difference and the thermal conductivity of the substrate material. Specifically, when the temperature difference approaches zero, materials of an almost infinite range of thermal conductivities can be used because, in effect, the substrate has been preheated up to the melting temperature of the spray deposited metal and thus no heat will be transferred to the substrate regardless of its thermal conductivity. Conversely, as the thermal conductivity approaches zero, the choice of substrate material narrows down to materials, such as glass, whose thermal conductivities are very small. Below the line on the graph the condition of the deposit is good, meaning that a sufficient fraction of liquid was present in the initial deposit to feed the inherent interstices between the splatted droplets and to provide a good interface for subsequent deposits and minimal porosity. On the other hand, above the line on the graph the condition of the deposit is not good, meaning that an inadequate fraction of liquid was provided and unacceptable porosity is present in the deposit.

It has been found that it is possible to produce alloy preforms with excellent surface quality and which are capable of being stripped from the substrate (i.e., non-consumable) for the unique conditions set forth in FIG. 2. In the spray chamber 22, the recirculation of the atomizing gas flow will produce a steady state temperature expected to be approximately 500 degrees C. for Cu base alloys. At this temperature, experiments indicate that substrates with thermal conductivities of 25 $w/m^2$-sec degrees K. or less will result in high quality strippable deposits. Examples of such materials include glasses, $Si_3N_4$, $Al_2O_3$ and A42 (Fe-42 Ni).

For iron and nickel base alloys where the steady state temperature can be expected to be 700 degrees C., the substrate thermal conductivity should be below 15 $w/m^2$-sec degrees K. Here glasses again would be acceptable while $Al_2O_3$ and $Si_3N_4$ would not work. For aluminum alloys the steady state temperature can be expected to be 200 degrees C. and substrates with thermal conductivities up to approximately 40 $w/m^2$-sec degrees K. can be used.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. In a molten metal gas-atomizing spray-depositing apparatus, the combination comprising:

(a) means employing a pressurized gas flow for atomizing a stream of molten metal into a spray pattern of semi-solid metal particles and producing a flow of said particles in said pattern thereof along with said gas flow in a generally downward direction;

(b) a substrate disposed below said atomizing means for impingement on said substrate of said gas flow at a steady state temperature resulting primarily from heat transfer by said metal particles to said gas flow and for receiving thereon a deposit of said particles in said spray pattern to form a product thereon; and (c) said substrate being composed of a material having a thermal conductivity correlated with said steady state temperature of said gas flow so as to limit heat transfer from said deposit to said substrate and thereby prevent complete solidification of an initial portion of said deposit contacting said substrate whereby a sufficient fraction of liquid is maintained in said initial deposit portion to feed the inherent interstices between the particles and to provide an interface with subsequent deposits, resulting in a reduction of porosity and improvement of flatness of the deposit, said correlation being such that for iron and nickel base alloys, the substrate thermal conductivity is below 15 $W/m^2$-sec degrees K., for aluminum alloys the substrate thermal conductivity is up to about 40 $W/m^2$-sec degrees K., and for copper base alloys, the substrate thermal conductivity is up to about 25 $W/m^2$-sec degrees K.

2. The apparatus as recited in claim 1, further comprising:

a spray chamber enclosing said atomizing means and said substrate, said steady state temperature being the temperature within said spray chamber at the region of deposit of said particles on said substrate.

3. The apparatus as recited in claim 1, wherein said material composing said substrate has a thermal conductivity correlated with the difference between the melting temperature of said molten metal and said steady state temperature of said gas flow.

4. In a molten metal gas-atomizing spray-depositing apparatus, the combination comprising:

(a) means employing a pressurized gas flow for atomizing a stream of molten metal into a spray pattern of semi-solid metal particles and producing a flow of said particles in said pattern thereof along with said gas flow in a generally downward direction;

(b) a substrate disposed below said atomizing means for impingement on said substrate of said gas flow at a steady state temperature resulting primarily from heat transfer by said metal particles to said gas flow and for receiving thereon a deposit of said particles in said spray pattern to form a product thereon;

(c) a spray chamber enclosing said atomizing means and said substrate, said steady state temperature being the temperature within said spray chamber at the region of deposit of said particles on said substrate; and (d) said substrate being composed of a material having a thermal conductivity correlated with the difference between the melting temperature of said molten metal and said steady state temperature of said gas flow so as to limit heat transfer from said deposit to said substrate and thereby prevent complete solidification of an initial portion of said deposit contacting said substrate whereby a sufficient fraction of liquid is maintained in said initial deposit portion to feed the interstices between the particles and provide an interface with subsequent deposits, resulting in a reduction of porosity and improvement of flatness of the deposit, said correlation being such that for iron and nickel base alloys, the substrate thermal conductivity is below 15 $W/m^2$-sec degrees K., for aluminum alloys the substrate thermal conductivity is up to about 40 $W/m^2$-sec degrees K., and for copper base alloys, the substrate thermal conductivity is up to about 25 $W/m^2$-sec degrees K.

5. In a molten metal gas-atomizing spray-depositing apparatus, the combination comprising:

(a) means employing a pressurized gas flow for atomizing a stream of molten metal into a spray pattern of semi-solid metal particles and producing a flow of said particles in said pattern thereof along with said gas flow in a generally downward direction;

(b) a substrate movable along a continuous path relative to said metal particles in said spray pattern thereof and being disposed below said atomizing means for impingement on said substrate of said gas flow at a steady state temperature resulting primarily from heat transfer by said metal particles to said gas flow and for receiving thereon a deposit of said particles in said spray pattern to form a product thereon;

(c) said substrate being composed of a material having a thermal conductivity correlated with said steady state temperature of said gas flow so as to limit heat transfer from said deposit to said substrate and thereby prevent complete solidification of an initial portion of said deposit contacting said substrate whereby a sufficient fraction of liquid is maintained in said initial deposit portion to feed the interstices between the particles and provide an interface with subsequent deposits, resulting in a reduction of porosity and improvement of flatness of the deposit, said correlation being such that for iron and nickel base alloys, the substrate thermal conductivity is below 15 $W/m^2$-sec degrees K., for aluminum alloys the substrate thermal conductivity is up to about 40 $W/m^2$-sec degrees K., and for copper base alloys, the substrate thermal conductivity is up to about 25 $W/m^2$-sec degrees K.

6. The apparatus as recited in claim 5, wherein said material composing said substrate has a thermal conductivity correlated with the difference between the melting temperature of said molten metal and said steady state temperature of said gas flow.

7. The apparatus as recited in claim 5, further comprising:

a spray chamber enclosing said atomizing means and said substrate, said steady state temperature being the temperature within said spray chamber at the region of deposit of said particles on said substrate.

* * * * *